United States Patent [19]

Mori et al.

[11] 4,294,134

[45] Oct. 13, 1981

[54] ACTUATING HANDLE MEANS

[75] Inventors: Keiji Mori; Kyoichi Kurimoto, both of Toyota, Japan

[73] Assignees: Aisin Seiki Kabushiki Kaisha, Kariya; Toyota Jidosha Kogyo Kabushiki Kaisha, Toyota, both of Japan

[21] Appl. No.: 51,233

[22] Filed: Jun. 22, 1979

[30] Foreign Application Priority Data

Jun. 23, 1978 [JP] Japan ..... 53/76074

[51] Int. Cl.[3] ..... G05G 1/00

[52] U.S. Cl. ..... 74/547; 296/223

[58] Field of Search ..... 74/547, 548, 545; 16/110 R, 112, 123, 126; 296/221, 223

[56] References Cited

U.S. PATENT DOCUMENTS

| | | | |
|---|---|---|---|
| 2,108,554 | 2/1938 | Berg | 74/547 |
| 2,994,232 | 8/1961 | Koeber | 74/547 X |
| 3,148,913 | 9/1964 | Golde | 296/223 |
| 3,383,945 | 5/1968 | Carella | 74/547 |
| 3,412,626 | 11/1968 | Zeigler et al. | 74/547 X |
| 4,023,858 | 5/1977 | Bienert et al. | 296/223 X |

*Primary Examiner*—Dave W. Arola

*Attorney, Agent, or Firm*—Finnegan, Henderson, Farabow, Garrett & Dunner

[57] ABSTRACT

Actuating handle means for vehicles including actuating handle lever means having one end pivotably connected with base plate means at a position remote from the actuating handle lever means for movement between an extended and folded positions, the actuating handle lever means being formed at the one end with a pair of spaced spring seat surface which are adapted to be engaged with the other end of resilient spring means in the extended and folded positions, respectively, the actuating handle lever means being further formed with an intermediate spring means between the spring seat surfaces so that the projection is overridden when the actuating handle means is moved between the extended and folded positions.

7 Claims, 12 Drawing Figures

ACTUATING HANDLE MEANS

The present invention relates to actuating handle means and more particularly to foldable actuating handle means for vehicles. The present invention can be most suitably applied to actuating handles for window glasses or sun-roofs of automobiles but the invention is not limited to such applications.

In automobiles or other vehicles wherein spaces for passengers are limited, it is recommendable to have actuating handles retracted or folded so that they do not project into the passenger rooms when they are not in use. Such retractable or foldable handles are preferable since it is possible to effectively prevent any inadvertent actuation of the handles when they are retracted or folded. Further, they can provide more room for passengers and present an improved appearance. These types of handles should therefore be of such design that they can be retracted to positions which are as low as possible and that they can be firmly held without any play both in the retracted and extended positions. Further, it is also required that they be of durable structure and can be operated smoothly without producing any uncomfortable noise.

It is therefore an object of the present invention to provide a retractable or foldable actuating handle for vehicles which can satisfactorily meet the above requirements.

Another object of the present invention is to provide a foldable actuating handle for vehicles which is simple in construction but can offer a smooth operation.

According to the present invention, the above and other objects can be accomplished by foldable actuating handle means for vehicles which comprises base plate means adapted to be engaged with actuating shaft means to rotate therewith, actuating handle lever means provided with an actuating knob and having one end pivotable connected with said base plate means at a position remote from said actuating handle lever means for movement between extended and folded positions, resilient spring means mounted on said base plate means and having one end constrained by said base plate means at a position diametrically opposite to the position where the actuating handle lever means is pivotably mounted on the base plate means, the resilient spring means having its other end adapted to resiliently bias the one end of the actuating handle means, said actuating handle lever means being formed at said one end with a pair of spaced spring seat surfaces which are adapted to be operatively engaged with said other end of the resilient spring means in the extended and folded positions, respectively, said spring means being deflected from its free position when its other end is operatively engaged with either of said spring seat surfaces, said actuating handle lever means being further formed with an intermediate projection between said spring seat surfaces so that the spring means is overridden when the actuating handle means is moved between the extended and folded positions.

In a preferable aspect of the present invention, the resilient spring means is comprised of a wire spring which is bent back at the other end in a U-shaped configuration and adapted to be engaged with the actuating handle means at the free end thereof so that the spring is twisted in operation. More preferably, two symmetrical wire spring sections may be provided and these two sections may be integrally connected together at the portion corresponding to the one end of the resilient spring means. According to the present invention, the resilient spring means can have a large operating length extending substantially diametrically across the base plate means so that it can produce an adequate resilient force with a relatively low stress level.

The above and other objects and features of the present invention will become apparent from the following description of preferred embodiments making reference to the accompanying drawings, in which.

Figure 2:
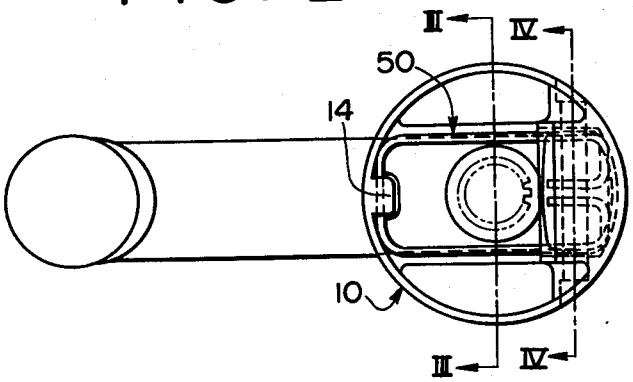
FIG. 2 is a plan view of the handle mechanism shown in FIG. 1.
Figure 5A:
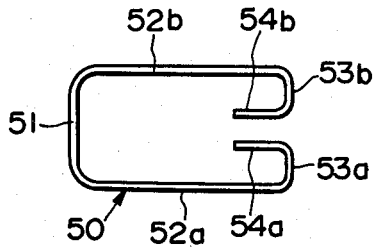
Figure 5C:
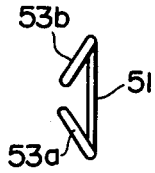
Figure 5B:
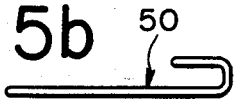
Figure 6A:
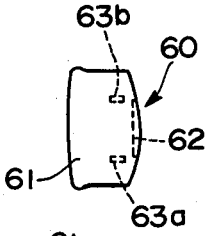
Figure 6C:
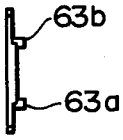
Figure 6B:
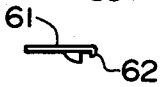
Figure 7:
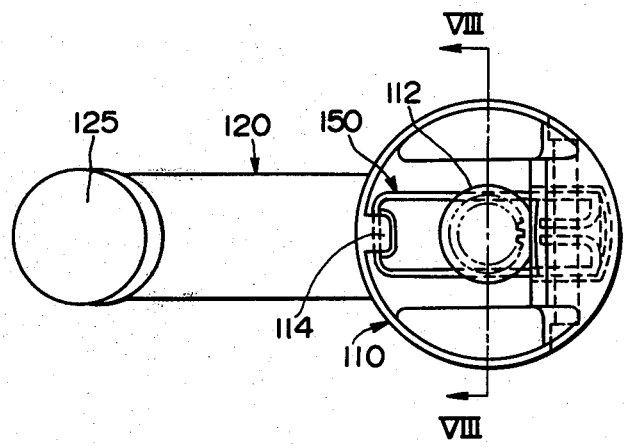
Figure 8:
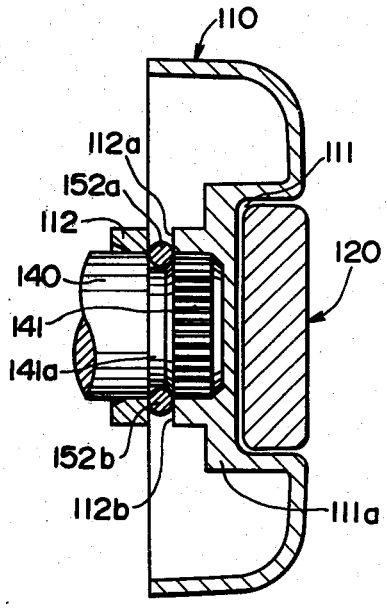

FIGS. 5*a, b* and *c* show a spring used in the actuating handle mechanism;

FIGS. 6*a, b* and *c* show an example of the spring seat plate;

FIG. 7 is a plan view similar to FIG. 2 but showing another embodiment; and, FIG. 8 is a sectional view taken substantially along the line VIII—VIII in FIG. 7.

Figure 1:
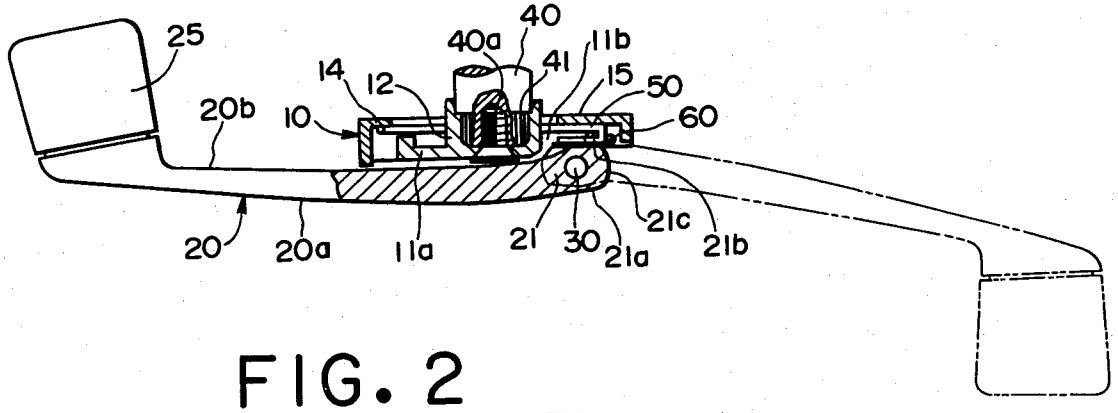
FIG. 1 is a sectional view showing an actuating handle mechanism in accordance with one embodiment of the present invention.
Figure 3:
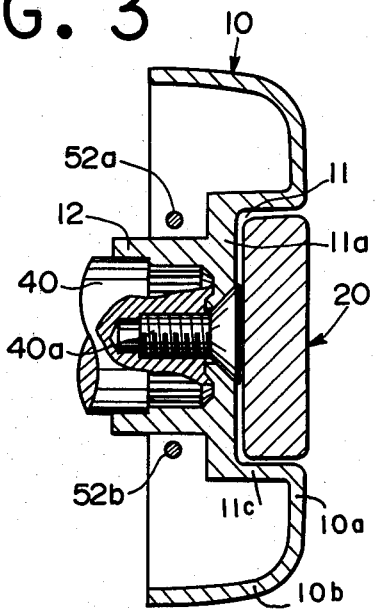
FIG. 3 is a sectional view taken substantially along the line III—III in FIG. 2.

Referring to the drawings, particularly to FIGS. 1 and 2, there is shown an actuating handle mechanism which may be used for an automobile window actuating mechanism. The actuating handle mechanism includes a base plate 10 which has a top wall 10*a* and a peripheral wall 10*b* as shown in FIG. 3. In the top wall 10*a* of the base plate 10, there is formed a diametrically extending recess or groove 11 and a boss 12 is provided at the center of the base plate 10 for engagement with an actuating shaft 40 of a window actuating mechanism. More specifically, the boss 12 is engaged with the actuating shaft 40 through splines 41 and secured thereto by means of a screw 40*a*.

The recess 11 in the top wall 10*a* of the base plate 10 has a bottom wall 11*a* which is cut-off at one end portion thereof to provide an opening 11*b* as shown in FIG. 1. Further, the recess 11 has a pair of side walls 11*c* on which an actuating handle lever 20 is mounted at its one end portion 21 through a pivot pin 30 which extends across the recess 11 between the side wall 11*c* in the vicinity of the opening 11*b*. The handle lever 20 is therefore pivotable about the axis of the pin 30 between a retracted or folded position in which the lever 20 lies as shown by solid lines in FIG. 1 in the recess 11 so that one side face 20*a* of the lever 20 is substantially flush with the surface of the top wall 10*a* of the base plate 10 and an extended position wherein the lever 20 is raised from the recess 11 as shown by phantom lines in FIG. 1. The handle lever 20 carries an actuating knob 25 which is mounted thereon at the side adjacent to the side face 20*b* which is opposite to the side face 20*a*. The actuating knob 25 thus projects in the extended position of the lever 20 to a position convenient for actuation.

The base plate 10 is formed at the side opposite to the top wall 10*a* with a retaining lip 14 which is located directly beneath the recess 11 at the end opposite to the opening 11*b*. At the diametrically opposite portion, the base plate 10 is formed with a spring support wall 15 which is continued through a pair of side walls 16*a* and 16*b* with the side walls 11*c* of the recess 11. A spring 50 is disposed in the base plate 10 and extends between the retaining lip 14 and the spring support wall 15. The spring 50 is made of a wire of spring steel and comprises a base end portion 51, a pair of parallel arm portions 52*a* and 52*b* extending from the base end portion 51, a pair of interconnecting portions 53*a* and 53*b* and a pair of leg portions 54*a* and 54*b* which are parallel with the arm portions 52*a* and 52*b* but lie in a plane different from the plane in which the arm portions 52*a* and 52*b* lie. The base end portion 51 is engaged with the retaining lip 14 and the arm portions 52*a* and 52*b* lie on the support wall 15 of the base plate 10 along the side walls 16*a* and 16*b* at the end portions opposite to the base end portion 51. The leg portions 54*a* and 54*b* are in engagement with the pivoted end portion 21 of the actuating lever 20 through a spring seat plate 60.

Figure 4:
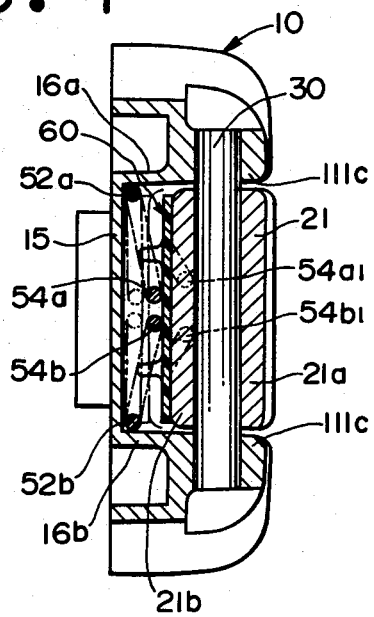
FIG. 4 is a sectional view taken substantially along the line IV—IV in FIG. 2.

The actuating lever 20 is formed at the pivoted end portion 21 with flat surfaces 21*a* and 21*b* and projection 21*c* between the flat surfaces 21*a* and 21*b*. The flat surfaces 21*a* and 21*b* are adapted to receive the spring seat plate 60 in the extended and retracted positions of the handle lever 20, respectively. In each of the extended and retracted positions of the handle lever 20, the leg portions 54*a* and 54*b* of the spring 50 are deflected from the free positions which are shown by the reference characters $54a_1$ and $54a_2$ in FIG. 4 so that the arm portions 52*a* and 52*b* are twisted and thus a certain amount of energy is stored in the spring 50.

When the handle lever 20 is moved from the retracted position to the extended position or vice versa, the projection 21*c* in the end portion 21 of the handle lever 20 forces the spring seat plate 60 so that the spring 50 is further deflected. As soon as the flat surface 21*a* or 21*b* engages with the spring seat plate 60, the deflection of the spring 50 is decreased. The spring 50 thus functions to maintain the handle lever 20 firmly either in the extended or retracted position. As shown in FIGS. 6*a*, *b* and *c*, the spring seat plate 60 comprises a base 61 which has a pawl 62 formed along one side edge thereof. Further, the base 61 is formed with a pair of projections 63*a* and 63*b* which, together with the pawl 62, functions to retain the plate 60 on the spring 50.

Referring now to FIGS. 7 and 8, the embodiment shown therein is substantially indentical to the previous embodiment so that corresponding parts are designated with the same reference numerals with addition of one hundred. According to the embodiment, the boss portion 112 of the base plate 110 is formed at the diametrically opposite sides with slots 112*a* as shown in FIG. 8 and the actuating shaft 140 is formed with a retaining groove 141*a*. As in the previous embodiment, the boss portion 112 is engaged with the actuating shaft 140 through splines 141. The spring 150 is engaged at its arm portions 152*a* and 152*b* with the retaining groove 141*a* of the shaft 140 through the slots 112*a* and 112*b* in the boss portion 112. In this manner, the base plate 110 is secured to the actuating shaft 140 against detachment.

The invention has thus been shown and described with reference to specific embodiments, however, it should be noted that the invention is in no way limited to the details of the illustrated structures but changes and modifications may be made without departing from the scope of the appended claims.

We claim:

1. Foldable actuating handle means for vehicles which comprises base plate means adapted to be engaged with actuating shaft means to rotate therewith, actuating handle lever means provided with an actuating knob and having one end pivotably connected with said base plate means at a position remote from said actuating knob for movement between extended and folded positions, resilient spring means mounted on said base plate means and having one end constrained by said base plate means at a position diametrically opposite to the position where the actuating handle lever means is pivotally mounted on the base plate means, the resilient spring means having its other end adapted to resiliently bias the one end of the actuating handle lever means, said actuating handle lever means being formed at said one end with a pair of spaced seat surfaces which are adapted to be operatively engaged with said other end of the resilient spring means in the extended and folded positions, respectively, said spring means being deflected from its free position when its other end is operatively engaged with either of said spring seat surfaces, said actuating handle lever means being further formed with an intermediate projection between said spring seat surfaces so that the spring means is overridden when the actuating handle means is moved between the extended and folded positions.

2. Handle means in accordance with claim 1 in which said resilient spring means is comprised of a wire spring which is bent at the other end portion to provide a U-shaped configuration having a free end portion adapted to be engaged with the actuating handle lever means whereby the wire spring is twisted when it is operatively engaged with either of said spring seat surfaces.

3. Handle means in accordance with claim 1 in which said resilient spring means comprises a wire spring including a pair of parallel arm portions which are connected together at one of their ends by means of a base portion to provide said one end of the spring means, each of said arm portions being bent at the other end to provide a U-shaped configuration having a free end portion adapted to be engaged with the actuating handle lever means, said free ends of the arm portions of the spring means lying in a plane offset from a plane in which said arm portion lies so that said arm portions are twisted when they are operatively engaged with either of said spring seat surfaces.

4. Handle means in accordance with claim 1 in which said base plate means includes top wall means having diametrically extending recess means for receiving said handle lever means in the folded position.

5. Handle means in accordance with claim 4 in which said base plate means is formed with lip means for constraining engagement with said base portion of the spring, said base plate means being further formed with support wall means for seating said other end portions of the arm portions of the spring.

6. Handle means in accordance with claim 4 in which the arm portions of the spring are located at the opposite sides of the actuating shaft means.

7. Handle means in accordance with claim 4 in which said base plate means is provided with boss means which is adapted to be fitted with said actuating shaft means, said boss means being formed at diametrically opposite sides with slots, said actuating shaft means being formed with circumferential groove means for cooperation with said slots in the boss means, said arm portions of the spring are disposed at the opposite sides of the actuating shaft means and engaged respectively through said slots with said circumferential groove means in the actuating shaft means.

* * * * *